US008387346B1

(12) United States Patent
Coates

(10) Patent No.: US 8,387,346 B1
(45) Date of Patent: Mar. 5, 2013

(54) METHOD OF GIFT BOX WRAPPING

(76) Inventor: Debora Coates, Spring Hill, FL (US)

( * ) Notice: Subject to any disclaimer, the term of this patent is extended or adjusted under 35 U.S.C. 154(b) by 333 days.

(21) Appl. No.: 12/902,576

(22) Filed: Oct. 12, 2010

(51) Int. Cl.
*B65B 61/00* (2006.01)
*B65B 11/58* (2006.01)
*B65D 65/38* (2006.01)

(52) U.S. Cl. ..... 53/415; 53/449; 53/465; 229/87.19; 229/116.5; 229/923

(58) Field of Classification Search ..... 53/415, 53/449, 461, 465, 173, 219; 229/87.18, 87.19, 229/116.5, 923
See application file for complete search history.

(56) References Cited

U.S. PATENT DOCUMENTS 2,008,168 A * 7/1935 Bergstein ..... 229/87.19
3,366,313 A * 1/1968 Culberg et al. ..... 229/87.19
5,337,943 A 8/1994 Hendren
5,414,976 A * 5/1995 Richards ..... 53/449
5,542,597 A 8/1996 Richards
5,971,264 A 10/1999 Karahoca
5,979,651 A 11/1999 Betts
6,187,403 B1 2/2001 Richardson
6,604,674 B1 * 8/2003 Bowman ..... 229/116.5
2003/0038168 A1 * 2/2003 Phillips ..... 229/87.19

* cited by examiner

*Primary Examiner* — Stephen F Gerrity

(57) ABSTRACT

A method of gift box wrapping utilizing a pre-formed and pre-taped wrapping paper sheet, having a marking on a back side thereof which divides the sheet into a first end and a second end, a placement area within the marking, and an embossed label integrally disposed on the sheet front side, with which a user wraps a gift box without the use of scissors and a roll of tape. A user places a gift box within the placement area and folds the first end over a portion of the gift box, then folds the second end over the gift box and secures the second end to a double-sided first adhesive strip disposed proximal to a first edge on the first end. The user then folds and secures the left and right sides of the sheet with double-sided second adhesive strips to encase the gift box therein.

6 Claims, 3 Drawing Sheets

METHOD OF GIFT BOX WRAPPING

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of gift wrapping devices are known in the prior art. However, what is needed is a method of wrapping gift boxes that utilizes a pre-formed and pre-taped wrapping paper sheet having a first adhesive strip disposed on a front side proximal to a first edge and a second adhesive strip on a back side proximal to each of the left and right sides and further having a marking on the back side with a placement area therein, the marking dividing the sheet into a first end and a second end, whereby a user places a gift box atop the placement area, folds the first end and then the second end over the gift box and secures the second end with the first adhesive strip to the first end, then folds left and right sides of the paper inwardly and secures the left and right sides in a fold position with the second adhesive strips thereby encasing the gift box and lid therein.

FIELD OF THE INVENTION

The present invention relates to gift wrap, and more particularly, to a method of gift box wrapping utilizing a pre-formed and pre-taped wrapping paper sheet, which has an embossed label integrally disposed on the sheet front side, with which a user wraps a gift box without the use of scissors and a roll of tape.

SUMMARY OF THE INVENTION

The general purpose of the present method of gift box wrapping, described subsequently in greater detail, is to provide a method of gift box wrapping which has many novel features that result in a method of gift box wrapping which is not anticipated, rendered obvious, suggested, or even implied by prior art, either alone or in combination thereof.

To accomplish this, the present method of gift box wrapping utilizes a pre-formed wrapping paper sheet having a two-sided adhesive strip, which has a removable backing, centrally disposed on a sheet back side and also disposed on one end of a sheet front side, as well as an embossed label integrally disposed on the sheet front side, with which a user wraps a gift box without the use of scissors and a roll of tape. The sheet back side bears a marking thereon. The marking outlines the perimeter of a top surface of a gift box. The sheet is pre-formed into one of three sizes—a large-size sheet, a medium-size sheet, and a small-size sheet—to cover standard-sized large, medium, and small gift boxes, respectively. The large-size sheet has a length of approximately 30 and a width of approximately 20 inches for wrapping a gift box having a height of approximately 2½ inches, a length of approximately 16¾ inches and a width of approximately 10¾ inches. The medium-size sheet has a length of approximately 26⅜ inches and a width of approximately 17¼ inches for wrapping a gift box having a height of approximately 2 inches, a length of approximately 14½ inches and a width of approximately 9½ inches. The small-size sheet has a length of approximately 13 inches and a width of approximately 10 inches for wrapping a gift box having a height of approximately 2 inches, a length of approximately 11 inches and a width of approximately 8 inches.

The pre-formation of each sheet of wrapping paper eliminates the need to locate and use scissors to cut a size of wrapping paper to accommodate the wrapping of a gift box. The adhesive strips eliminate the need to find and use a roll of tape as well as a tape dispenser. In addition, each of the sheets is formed of a wide range of visual designs symbolic of a wide range of occasions, including holidays and birthdays.

The present method of wrapping a gift box saves time, reduces the waste of wrapping paper and tape, and reduces the effort involved in wrapping a gift box by eliminating the need to measure and cut the wrapping paper to fit a gift box. The present method also reduces time required to wrap a gift and reduces the risk of injury by eliminating the need to look for and use scissors. The present method makes the wrapping of a gift box easy and hassle-free and results in a gift wrap that resembles a professional gift wrap. The present method also promotes the joy of unwrapping gifts, rather than opening gift bags.

Thus has been broadly outlined the more important features of the present method of gift box wrapping and method so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
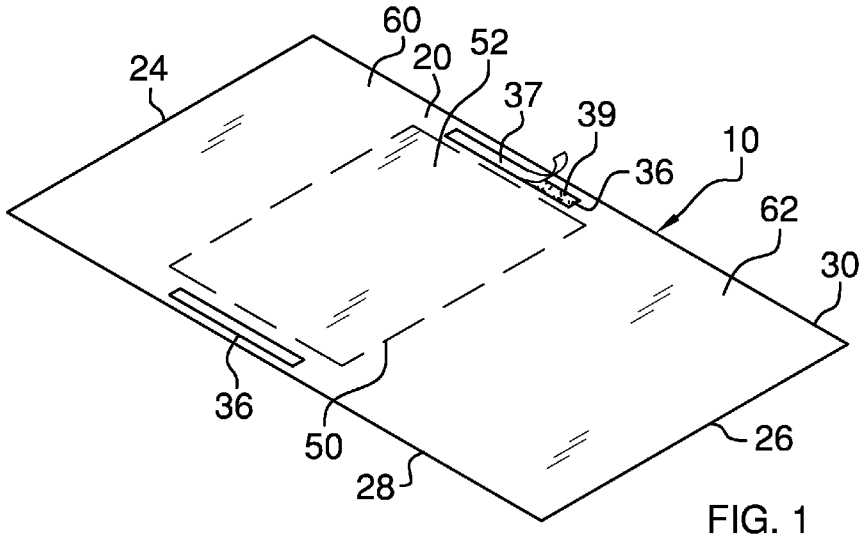
FIG. 1 is an isometric rear view.
Figure 2:
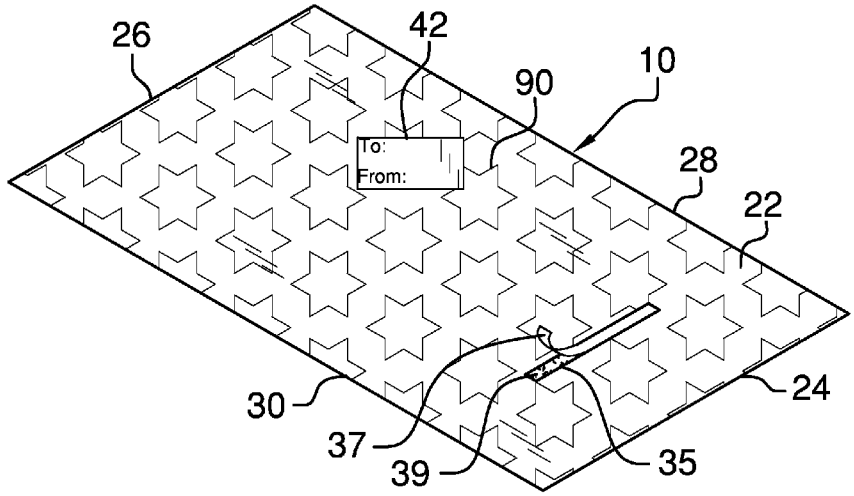
FIG. 2 is an isometric front view.
Figure 3:
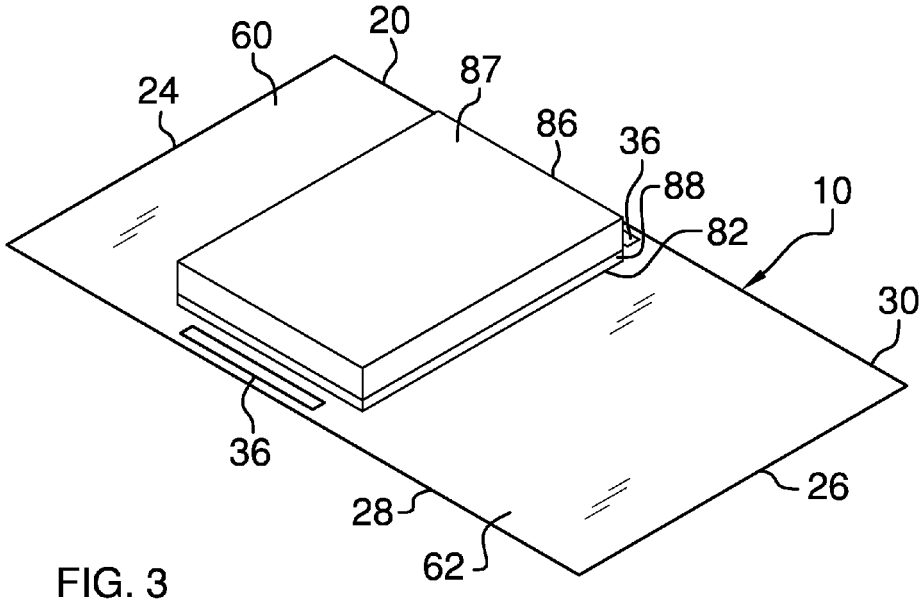
FIG. 3 is an in-use rear isometric view illustrating the placement of a gift box on a back side of a sheet of wrapping paper.
Figure 4:
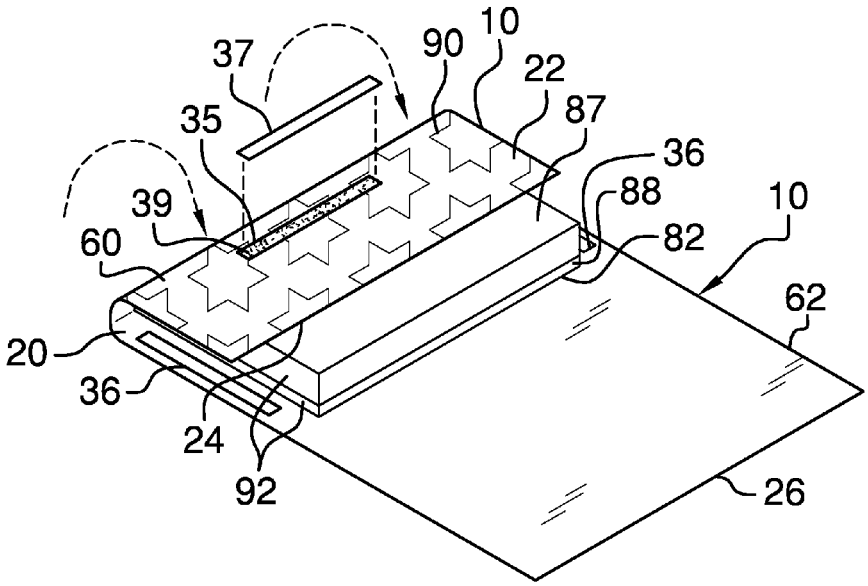
FIG. 4 is an in-use isometric view illustrating the initial folding of the sheet of wrapping paper over a first side of a gift box and the removal of a backing from an adhesive strip.
Figure 5:
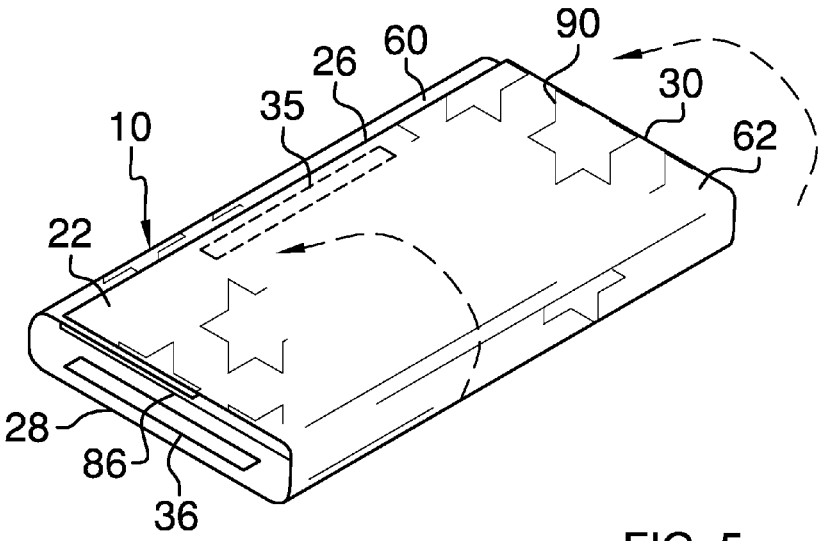
FIG. 5 is an in-use isometric view illustrating the secondary folding of the sheet of wrapping paper over a second side of a gift box.
Figure 6:
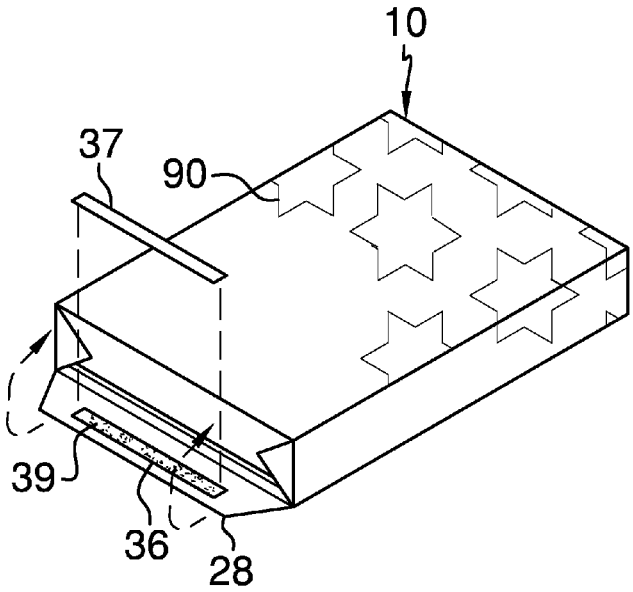
FIG. 6 is an in-use isometric view illustrating the folding of the sheet of wrapping paper over an end of the gift box and the removal of the backing from an adhesive strip.

With reference now to the drawings, and in particular FIGS. 1 through 6 thereof, example of the instant method of gift box wrapping employing the principles and concepts of the present method of gift box wrapping and generally designated by the reference number 10 will be described.

Referring to FIGS. 1 through 6 a preferred embodiment of the present method of gift box wrapping is illustrated. The present method of gift box wrapping utilizes a pre-formed wrapping paper sheet 10 to allow a user to wraps a gift box 86 without the use of scissors and a roll of tape.

The wrapping paper sheet 10 has a back side 20, a front side 22, a first edge 24, a second edge 26, a left side 28, and a right side 30. A double-sided adhesive strip 36 is centrally disposed on the wrapping paper sheet 10 back side 20 proximal to each of the left side 28 and the right side 30 in a position parallel to each of the left side 28 and the right side 30 respectively. A removable peel-off backing 37 is removably attached to an outer side of the adhesive strip 35. An adhesive strip 35 is also centrally disposed on the wrapping paper sheet 10 front side 22 between the left side 28 and the right side 30 approximately one-quarter of a length of the wrapping paper sheet 10 from the first edge 24 in a position parallel to the first edge 24.

An embossed label 42 is integrated into the wrapping paper sheet 10 front side 22. The wrapping paper sheet 10 back side 20 bears a marking 45 thereon. The marking 45 is a visual indicia of the upper perimeter 82 of a gift box 86 lid 88. A placement area 52 is disposed within the entire marking 45. The marking 45 divides the wrapping paper sheet 10 into a first end 60 and a second end 62.

The wrapping paper sheet 10 is pre-formed into at least three sizes thus permitting a user to wrap standard-sized small, medium, and large gift boxes 86. The wrapping paper sheet removably covers a gift box and lid attached thereto having a total outside area slightly smaller than a total area of the wrapping paper sheet One size of wrapping paper sheet 10 has a length of approximately 30 and a width of approximately 20 inches for wrapping a gift box having a height of approximately 2½ inches, a length of approximately 16¾ inches and a width of approximately 10¾ inches. Another size of wrapping paper sheet 10 has a length of approximately 26⅜ inches and a width of approximately 17¼ inches for wrapping a gift box having a height of approximately 2 inches, a length of approximately 14½ inches and a width of approximately 9½ inches. Yet another size of wrapping paper sheet 10 has a length of approximately 13 inches and a width of approximately 10 inches for wrapping a gift box having a height of approximately 2 inches, a length of approximately 11 inches and a width of approximately 8 inches.

The pre-formation of each wrapping paper sheet 10 eliminates the need to locate and use scissors to cut a size of wrapping paper sheet 10 to accommodate the wrapping of a gift box 86. The adhesive strips 35, 36 eliminate the need to find and use a roll of tape as well as a tape dispenser. In addition, each of the wrapping paper sheets 10 is formed of a wide range of visual designs 90 symbolic of a wide range of occasions, including holidays and birthdays.

Use:

The present method of gift box wrapping begins with selecting a wrapping paper sheet 10 sized to accommodate the wrapping of a gift box 86 which is slightly smaller than a size of the wrapping paper sheet 10. The use continues by flattening and placing one of the wrapping paper sheets 10 on a smooth flat surface with the front side 22 disposed against the flat surface. Use continues with removably attaching the lid 88 onto the gift box 86, turning the gift box 86 to be wrapped upside down, and placing the lid 88 into the placement area 52 within the marking 50 on the back side 20 of the wrapping paper sheet 10. This is followed by grasping the first edge 24 of the wrapping paper sheet 10 and completely folding the back side 20 of the first end 60 over a portion of a bottom wall 87 of the gift box 86. Then, the user continues by peeling the backing 37 away from the outer side 29 of the adhesive strip 35 disposed on the front side 22 of the wrapping paper sheet. Use proceeds by grasping the second edge 26 and pulling the second edge 26 toward the first edge 24 and completely folding the second end 62 over the gift box 86 bottom wall 87 and securing the back side 20 of the second edge 26 on the second end 62 to the adhesive strip 35 disposed on the front side 22 of the wrapping paper sheet. The user continues use by folding each of the left side 28 and the right side 30 of the wrapping paper sheet 10 inwardly thereby completely covering each of an exterior side 92 of the gift box 86 and lid. Peeling the backing away from the outer side of the adhesive strip 36 disposed on the wrapping paper sheet 10 back side 20 proximal to each of the left side 28 and the right side 30 and securing the adhesive strip to the left side 28 and the right side 30 in a folded position over the exterior side 92 of the gift box 86 and lid 88 whereby the gift box 86 and lid 88 are completely encased within the wrapping paper sheet 10. The user finishes the gift box wrapping process by writing on the label 42.

What is claimed is:

1. A method of gift box wrapping comprising:

flattening a pre-formed wrapping paper sheet having a back side, a front side, a left side and a right side and placing the wrapping paper sheet on a smooth flat surface with the front side disposed against the flat surface;

removably attaching a lid onto a gift box;

turning the gift box upside down and placing the lid into a placement area disposed completely within a marking disposed on the wrapping paper sheet back side, the marking disposed slightly more proximal to a first edge than an opposite second edge of the wrapping paper sheet, the marking further dividing the wrapping paper sheet into a first end and a second end, wherein the marking is a visual indicia of the upper perimeter of the gift box lid;

grasping the first edge of the wrapping paper sheet;

completely folding the back side of the first end over a portion of a bottom wall of the gift box;

peeling a peel-off backing away from an outer side of a double-sided first adhesive strip disposed on the front side of the wrapping paper sheet;

grasping the second edge of the wrapping paper sheet;

pulling the second edge toward the first edge;

completely folding the second end over the gift box bottom wall;

securing the back side of the second edge disposed on the second end to the first adhesive strip centrally disposed on the front side of the wrapping paper sheet proximal to the first edge of the first end in a position parallel to the first edge, the adhesive strip having a backing on an outer side thereof;

folding each of the left side and the right side of the wrapping paper sheet inwardly thereby completely covering each of an exterior side of the gift box and lid;

peeling the backing away from the outer side of a double-sided second adhesive strip disposed on the wrapping paper sheet back side proximal to each of the left side and the right side in a position parallel to each of the left side and the right side, respectively;

securing each of the second adhesive strips to the left side and the right side in a folded position over the exterior side of the gift box and lid whereby the gift box and lid are completely encased within the wrapping paper sheet.

2. The method of claim 1 further comprising selecting a wrapping paper sheet, wherein the wrapping paper sheet removably covers a gift box and lid attached thereto having a total outside area slightly smaller than a total area of the wrapping paper sheet.

3. The method of claim 2 further comprising selecting a wrapping paper sheet having a length of approximately 30 and a width of approximately 20 inches, wherein the wrapping paper sheet removably covers a gift box having a height of approximately 2½ inches, a length of approximately 16¾ inches and a width of approximately 10¾ inches.

4. The method of claim 3 further comprising alternately selecting a wrapping paper sheet having a length of approximately 26⅜ inches and a width of approximately 17¼ inches wherein the wrapping paper sheet removably covers a gift box having a height of approximately 2 inches, a length of approximately 14½ inches and a width of approximately 9½ inches.

5. The method of claim 4 further comprising alternately selecting a wrapping paper sheet having a length of approximately 13 inches and a width of approximately 10 inches, wherein the wrapping paper sheet removably covers a gift box having a height of approximately 2 inches, a length of approximately 11 inches and a width of approximately 8 inches.

6. The method of claim 5 further comprising writing on a label, the label integrated into the front side of the wrapping paper sheet.

* * * * *